US012448969B2

(12) United States Patent
Alsubaih

(10) Patent No.: US 12,448,969 B2
(45) Date of Patent: Oct. 21, 2025

(54) ROTARY RADIAL VANE COMPRESSOR

(71) Applicant: Adel K Alsubaih, Kaifan (KW)

(72) Inventor: Adel K Alsubaih, Kaifan (KW)

( * ) Notice: Subject to any disclaimer, the term of this patent is extended or adjusted under 35 U.S.C. 154(b) by 0 days.

(21) Appl. No.: 18/432,079

(22) Filed: Feb. 5, 2024

(65) Prior Publication Data

US 2025/0250980 A1 Aug. 7, 2025

(51) Int. Cl.
*F04C 18/356* (2006.01)

(52) U.S. Cl.
CPC ..... *F04C 18/356* (2013.01); *F04C 2240/30* (2013.01); *F04C 2240/807* (2013.01)

(58) Field of Classification Search
CPC .. F04C 18/44; F04C 2240/20; F04C 2240/30; F04C 27/005; F04C 2/344; F04C 29/12; F04C 29/026; F04C 18/344; F04C 27/001; F01C 21/0881; F01C 1/3445; F01C 21/0836
See application file for complete search history.

(56) References Cited

U.S. PATENT DOCUMENTS 3,016,184 A * 1/1962 Hart ..... F04C 29/02 418/101
3,385,513 A * 5/1968 Kilgore ..... F25B 31/026 418/82
3,652,191 A * 3/1972 King ..... F04C 27/001 418/125
3,865,515 A * 2/1975 Allen ..... F04C 29/026 417/310
8,540,500 B1 * 9/2013 Balkus, Jr. ..... F01C 21/04 418/83

FOREIGN PATENT DOCUMENTS

WO WO-2014132969 A1 * 9/2014 ..... F01C 21/0827

OTHER PUBLICATIONS

WO-2014132969-A1 English Translation (Year: 2014).*

* cited by examiner

*Primary Examiner* — Anthony Ayala Delgado
(74) *Attorney, Agent, or Firm* — Sam Pierce

(57) ABSTRACT

A rotary radial vane compressor comprising a cylindrical casing with slight undercut to make a contact sealing area with an off-center rotor. The rotor has one or more radial or offset vanes sliding within slots with a spring forcing it outward. The end of each vane cut in semi cylindrical shape to act as a sealed pivot for a sealing shoe mounted with crescent shaped profile. The sealing shoe casing side cut same as the casing radius and long enough to run over the undercut smoothly. The rotor has a cut space so that it houses the shoe fully in it when running over the undercut in the casing. The casing has intake and discharge ports with inner slot feed and exit extensions. During operation, as the rotor rotates, a cavity formed between the casing, the rotor, and the vane-shoe sets cyclically expands.

5 Claims, 6 Drawing Sheets

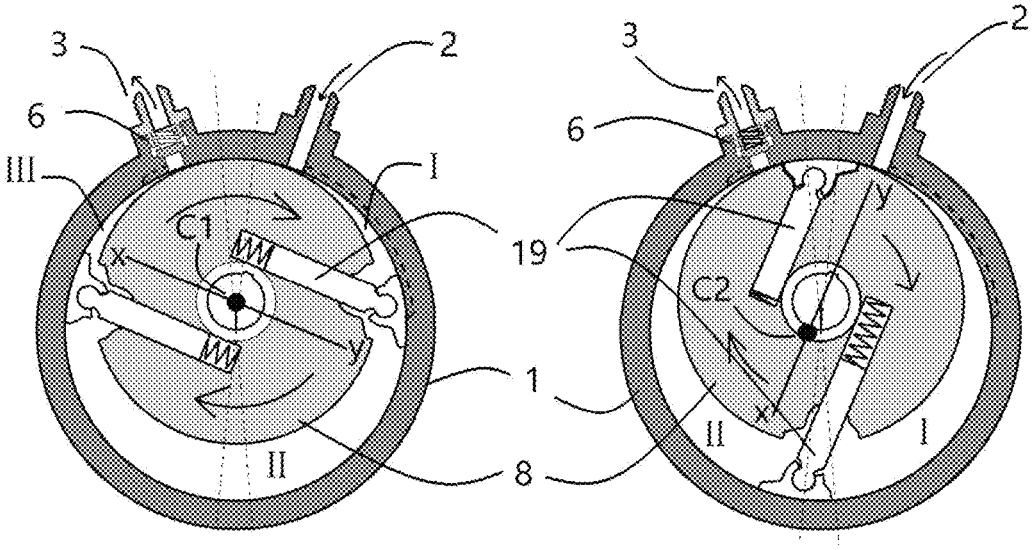
Fig. 6
( A ) ( B )
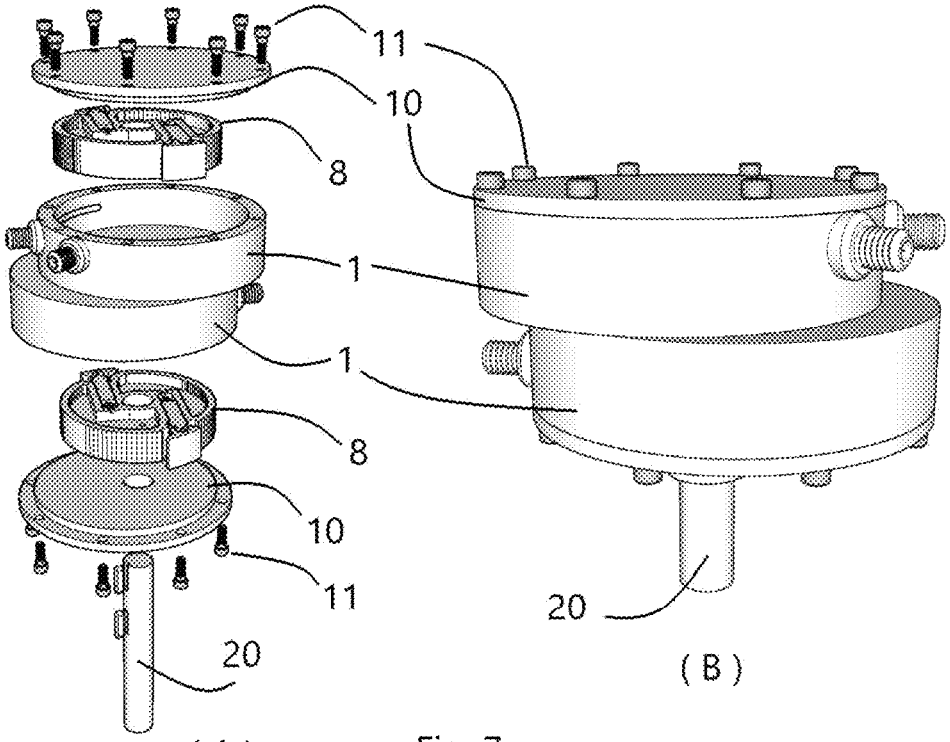
( A ) Fig. 7 ( B )

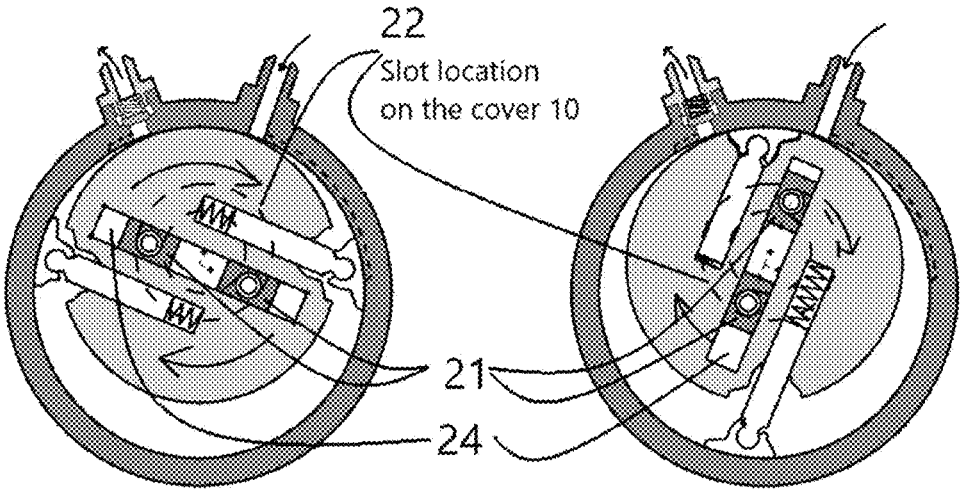
(A) Fig. 8 (B)
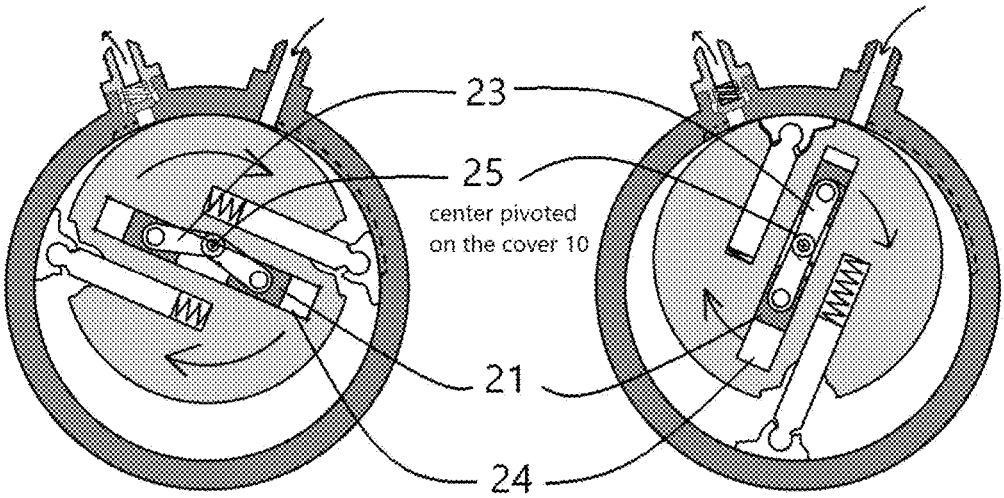
(A) Fig. 9 (B)

ROTARY RADIAL VANE COMPRESSOR

BACKGROUND

A compressor is an apparatus that receives power from a power generating apparatus, such as a motor or a turbine, and compresses a working fluid, such as air or refrigerant. Compressors are widely applied to industrial and household appliances.

Rotary compressors cover lobe-type, screw-type, vane-type, and liquid ring type, each having a casing with one or more rotating elements that either mesh with each other, such as lobes or screws, or that displace a fixed volume with each rotation.

A rotary vane compressor is a compressor unit that consists of a cylindrical housing, adjustable rotary vanes on an off-centered drive shaft, an air inlet and an air outlet. Because the drive shaft is off-centered, the blades create airtight chambers of varying sizes as they push against the cylinder wall.

Prior art vane rotary compressors suffer from limitations including lack of efficiency, reliability and leak.

SUMMARY OF INVENTION

Therefore, the present invention provides an improved rotary radial vane compressor.

According to an aspect of the present invention, there is provided rotary radial vane compressor, comprising: an off-center rotor having one or more radial or offset vanes sliding within slots with a spring force directed outwards; a cylindrical casing with slight undercut to make a contact sealing area with an off-center rotor; and intake and discharge ports with inner slot feed and exit extensions.

BRIEF DESCRIPTION OF THE DRAWINGS

FIG. 6: the vanes at extreme positions.

FIG. 8: live counterweight driven by slot guide at the two extreme positions.

FIG. 9: live counterweight driven by slider-crank mechanism at the two extreme positions.

DETAILED DESCRIPTION

Embodiments of the present invention are rotary radial vane compressors as described in this document. The rotary radial vane compressor consists of a cylindrical casing with slight undercut to make a contact sealing area with the off-center rotor. The rotor has two radial or offset vanes sliding within slots with spring forcing it outward.

The end of each vane cut in semi cylindrical shape acts as a sealed pivot for a sealing shoe mounted with crescent shaped profile. The sealing shoe casing side cut same as the casing radius and long enough to run over the undercut smoothly. The rotor is undercut so that it houses the shoe fully in it when running over the undercut. The casing has intake and discharge ports with inner slot feed and exit extensions.

During operation, as the rotor rotates, the cavity formed between the casing, the rotor, and the vane-shoe sets will cyclically expand from the minimum volume at the intake port to maximum volume then back to minimum volume, compressing (or pumping) its fluid content to a very high ratio out through the discharge port. The compressor is balanced by making it in pair casings mounted with 180 degree offset with one drive shaft. or with live counterweight balancing mechanism, as will be explained later in this document.

Figure 1:
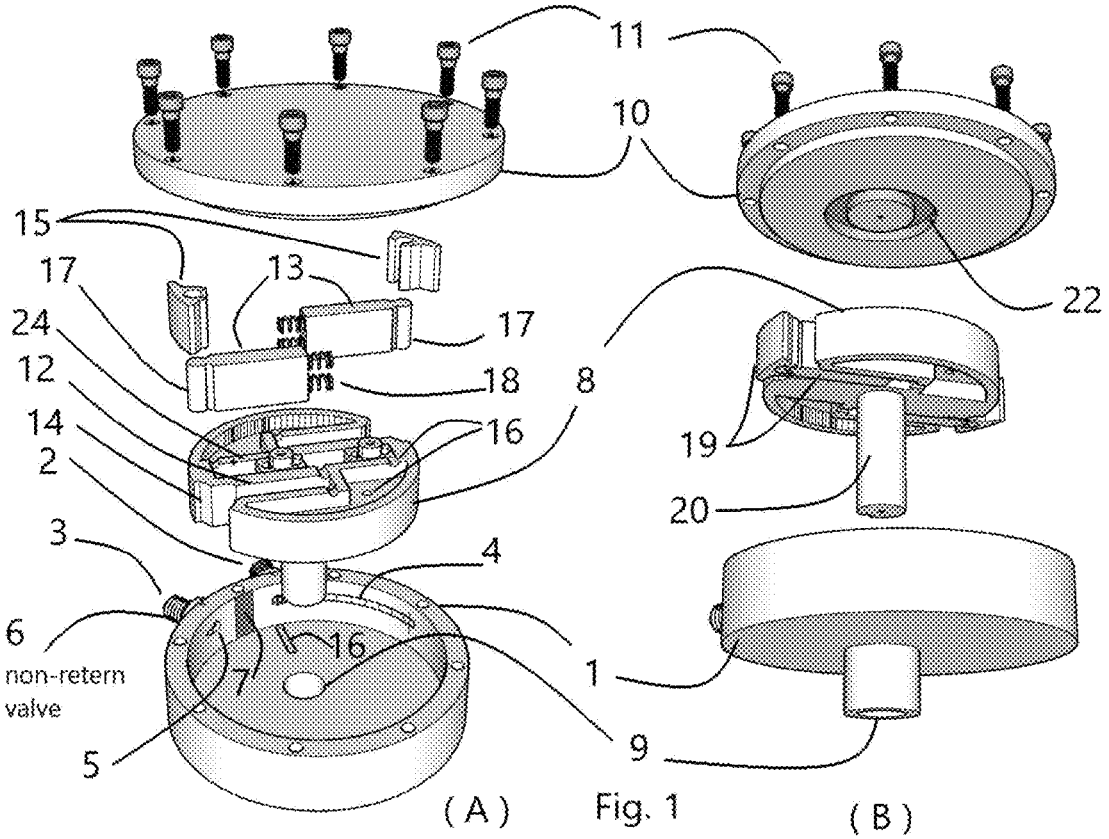
FIG. 1: assembly view showing all parts.
Figure 2:
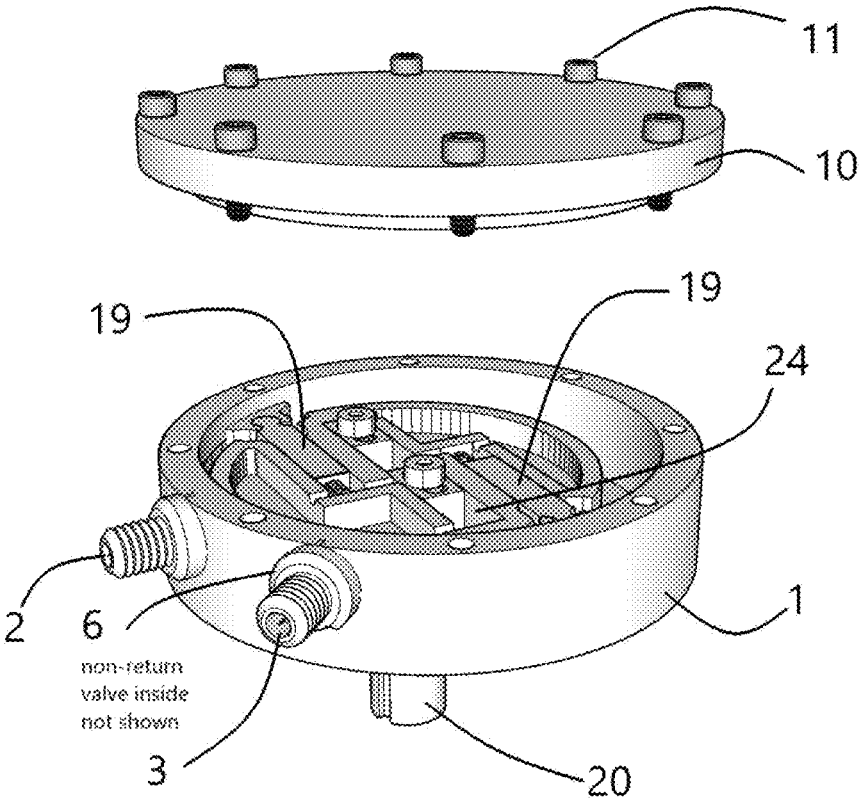
FIG. 2: semi assembled view showing all the moving parts assembled inside the casing.
Figure 3:
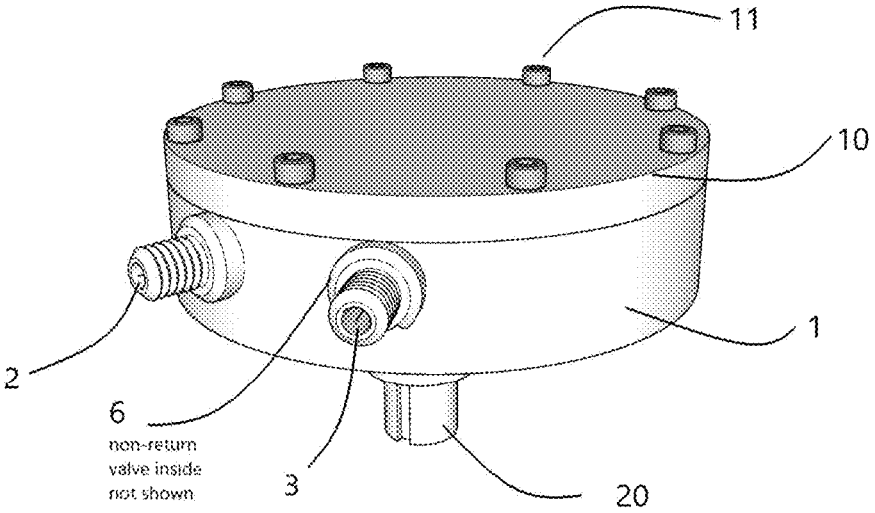
FIG. 3: assembled view showing the compactness of the device.

The casing 1 in FIG. 1, is cylindrical cavity with intake 2 and discharge 3 ports. The intake port 2 has inner slot 4 to extend fluid supply to the full volume position. The discharge port 3 has short inner slot 5 to widen flow section at discharge port 3. The discharge port also equipped with non-return valve 6 (shown in FIG. 6). The cylindrical casing has undercut 7 at the casing/rotor contact aria with the rotor 8 radius with small enough clearance and long enough length to make short frictionless sealed contact area. The undercut enlarged in FIG. 4 to show the undercut done on the casing with rotor radius.

It has a sealed offset shaft opening 9.

The casing has a sealed cover 10 with mounting screws 11.

The rotor 8 is cylindrical solid with radius less than the inner casing 1 radius. It has one or more radial or offset slots 12 to house sliders vane 13 of the same height. At the end of each slot 12, the rotor is undercut 14 to house the sealing shoe 15 in it when it run over the casing/rotor undercut 7. The rotor is vented 16 form inside to the low-pressure side so that the motion of the vanes will not be restricted by trapped pressure or vacuum. The rotor 8 driven by the shaft 20, which is extended out of the casing through the sealed opening 9.

The device can function with one vane but will require balancing such as twin casing, as will be described later.

The vanes 13 are sliders block with semi-cylindrical end 17 to pivot a sealing shoe 15. The vanes slides within the slots 12 in the rotor 8 with spring 18 forcing it outward so that the shoe 15 is continually in contact with the casing 1 inner cylindrical wall.

The sealing shoe 15 is extruded shaped part with the same height as the rotor 8, with crescent shaped vane side to be pivoted on the vane semi-cylindrical 17 end with sealing clearance. The shoe casing side is cut with the casing 1 inner radius to make good seal and long enough to smoothly run over the undercut 7.

Figure 4:
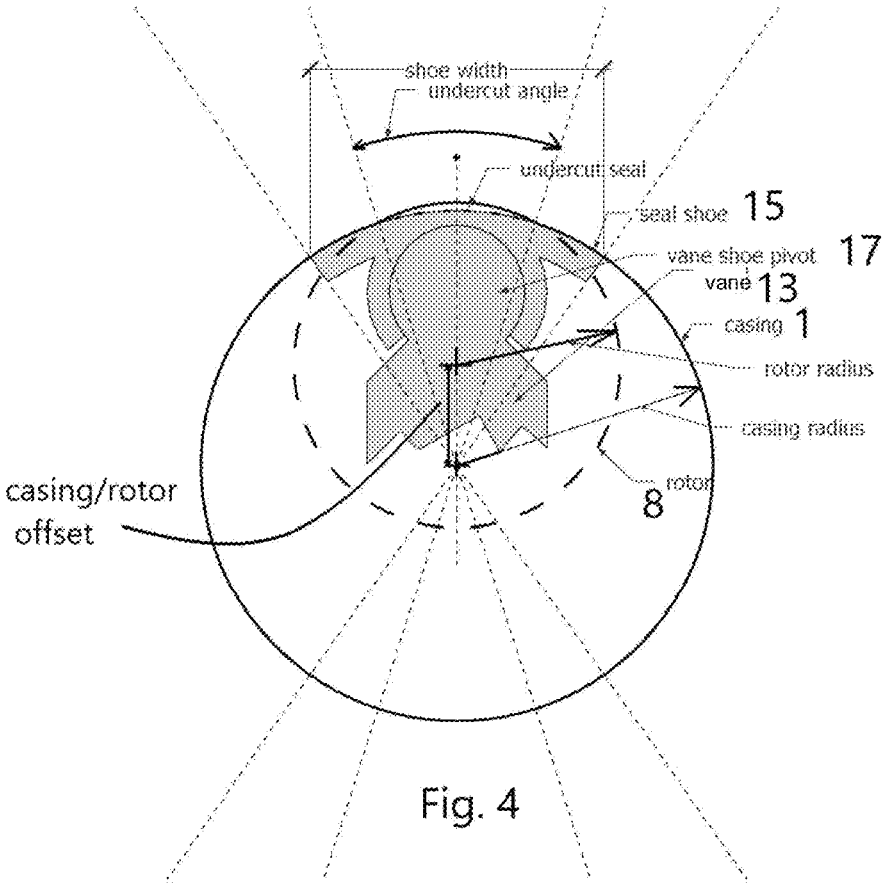
FIG. 4: exaggerated drawing showing the undercut in relation to the casing, the shoe and the rotor.
Figure 5:
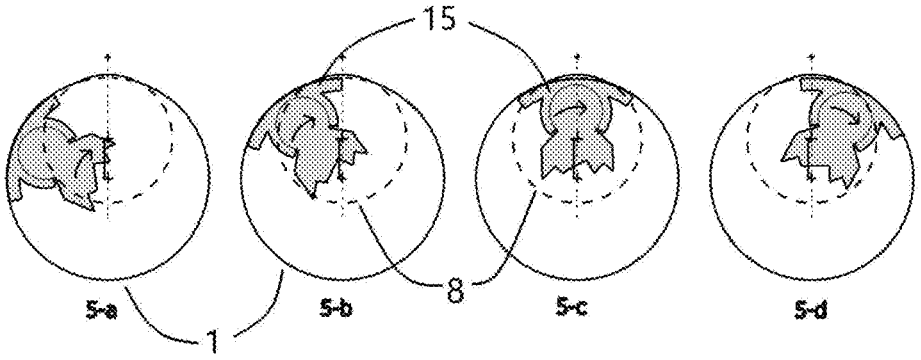
FIG. 5: exaggerated successive view showing the shoe running smoothly over the undercut.
Figure 7:
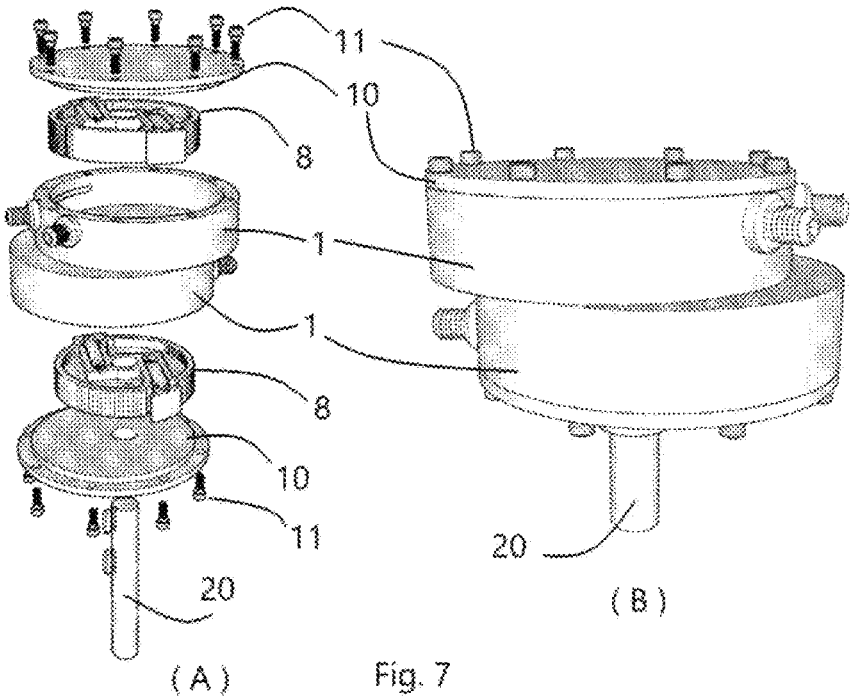
FIG. 7: twin casing unit, which balance each other.

FIG. 4, showing enlarged view of the undercut with the shoe running over it, while FIG. 5, showing successive view of the shoe running over the undercut without interruption.

The set consisting of the spring 18, slider 13 and shoe 15 called "vane set" 19 and all have the same height as the rotor 8.

For two vanes compressor, for example, there will be three chambers at all-time made by the volume bounded by the casing 1, the rotor 8, the vanes/shoe set 19 and the undercut seal 7. The chamber I, FIG. 6, at the intake 2, chamber II at the maximum volume and chamber III at the discharge. As the rotor driven clockwise, for example, each chamber will progress from near zero volume (chamber I) to maximum volume (chamber II) and back to near zero volume (chamber II) compressing or pumping its fluid content out of the discharge port 3 through the one-way valve 6. The shoe 15 will run over the slight undercut 7 smoothly without interruption to motion or seal.

For one vane compressor, there will be two chambers only, one in intake mode and the other in discharge mode. Chambers will switch modes when the shoe pass over the sealing undercut. In this case, the compressor can be made with twin casings, mounted 180 degree out of phase with a rotor 8 and one vane set 19 in each, and driven by one shaft 20. This will perfectly balance the operation at any speed.

Balancing Mechanism:

The rotating rotor core is well balanced. The vane set needs to be as light as possible to avoid excessive vibration. At some operating speeds or applications, the vane set may need to be balanced. By analyzing the extreme vane set positions, FIG. 6, it is noticed that the center of mass always will be along the line xy. At position A the center of mass C1 will be at the center, while at position B the center of mass will be at a some distance C2 from the center, hence, a counterweight mass is needed. Below some option to balance the compressor.

Twin Casing Compressor:

Compressor made to have two casings 1 mounted 180 degree out of phase, back to back. Each casing has one rotor 8 and one or more vane sets 19, which are also, mounted 180 degree out of phase on the shaft 20, so that one balances the other. This will balance the compressor without any further complicated mechanism.

Single Casing Compressor:

Since the center of mass of the vane sets shifts twice per rotation, hence live counterweight masses 21 needed within a sliding slot 24 on the rotor 8. The movement of the rotor 8 with respect to the fixed casing cover 10 will drive those masses via (a) a roller on the masses running within a slot guide 22 on the casing cover 10, FIG. 8, or (b) by a crank-slider mechanism 23 pin pivoted 25 on the casing cover 10, FIG. 9.

Counterweight Slot Drive, FIG. 8:

The slot guide 22 on the cover 10 designed to locate the masses 21 at positions so that their center of mass is located at the proper balancing location. This option allow for designing the slot 22 to move the center of mass for the counterweight exactly as needed by the design.

Counterweight Crank-Slider Mechanism Drive, FIG. 9:

Alternatively, counterweight masses 21 in the rotor masses slot 24 connected with linkages 23 pivoted off the rotor 8 center on the casing cover 10 (pivot pin 25) to drive the masses in the rotor masses slider way 24 in a crank-slider type mechanism. The masses driven so that the center of mass be in the right location at the extreme positions to counter balance the vane sets center of mass. The cover 10 would have a circular recess to allow for the linkages 23 to move freely.

The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Therefore, it is intended that the disclosure not be limited to the particular embodiment(s) disclosed.

What is claimed is:

1. A rotary radial vane compressor, comprising:

an off-center rotor having one or more radial or offset vanes sliding within slots with a spring force directed outwards;

a cylindrical casing with an undercut to make a contact sealing area with the off-center rotor;

intake and discharge ports with inner slot feed and exit extensions;

a sealed undercut between the casing and the rotor to seal between intake and discharge ports; and a pivoted shoe that seals with the casing, wherein a rotor cylindrical body runs within the casing undercut and the pivoted shoe hovers over the casing undercut; and a balancing mechanism to move a counterweight positioned to avoid vibration at medium and high speeds, the balancing mechanism comprising multiple casing mounted out of phase, a slot driven counterweight balancing mechanism and a linkages driven counterweight balancing mechanism.

2. The rotary radial vane compressor of claim 1, wherein the shoe that passes over the undercut without interruption.

3. The rotary radial vane compressor of claim 2, further comprising a cut space on the rotor to fully house the shoe when running over the undercut.

4. The rotary radial vane compressor of claim 1, further comprising a paired casing balancing mechanism.

5. The rotary radial vane compressor of claim 1, wherein the cavity formed between the casing, the rotor, and the vane-shoe sets cyclically expands from the minimum volume at the intake port to maximum volume then back to minimum volume.

* * * * *